United States Patent [19]

Shubin et al.

[11] 3,986,381

[45] Oct. 19, 1976

[54] BENDING HEAD FOR A TUBE BENDING MACHINE

[76] Inventors: Vladimir Nikolaevich Shubin, Pervomaiskaya ulitsa, 1, kv. 103; Viktor Sergeevich Silantiev, Kastanaevskaya ulitsa, 57, korpus 1, kv. 58.; Alexandr Sergeevich Khlyntsev, Kolenchataya ulitsa, 4-a, kv. 8, all of Moscow, U.S.S.R.

[22] Filed: May 5, 1975

[21] Appl. No.: 574,465

[52] U.S. Cl. ..... 72/217

[51] Int. Cl.[2] ..... B21D 7/024

[58] Field of Search ..... 72/217, 216, 149, 166, 72/170

[56] References Cited

UNITED STATES PATENTS

| | | | |
|---|---|---|---|
| 3,373,587 | 3/1968 | Shubin et al. | 72/158 |
| 3,680,347 | 8/1972 | Schenk et al. | 72/217 |
| 3,845,648 | 11/1974 | Shubin et al. | 72/216 |

*Primary Examiner*—Milton S. Mehr
*Attorney, Agent, or Firm*—Lackenbach, Lilling & Siegel

[57] ABSTRACT

A bending head for a tube bending machine which includes a housing, having a through axial passage, mounted in a cantilever fashion on the framework of the machine for forceful rotation about its axis, the tube or billet being pushed through the head along this axis during a bending operation. The free end of the housing has mounted in the passage thereof a pair of support rolls and a pivotable arm, kinematically connected to the drive of the machine through a screw-and-nut couple and a gear, carrying a bending roll. The axes of rotation of the rolls and of the pivoting of the arm are substantially perpendicular to the axis of rotation of the housing. There is mounted in opposition to each support roll and the bending roll a respectively similar additional roll positioned symmetrically with respect to the axis of rotation of the housing. The axis of pivoting of the pivotable arm lies in the same plane with the axis of rotation of the housing mounted adjacent to said gear and coaxially therewith is a second gear fast on the housing and independently kinematically connected to the drive of the machine. The employment of the bending head of the disclosed structure provides for a higher productivity of the bending machine of a similar known type, owing to the continuity of the bending operation and to the reduction of the maximum angle through which the housing may be required to rotate, down to 90° (at varying the bending plane), and also broadens the production capacity of the machine, due to the reversibility of rotation of the housing and of the bending direction, either separately or in combination.

4 Claims, 7 Drawing Figures

BENDING HEAD FOR A TUBE BENDING MACHINE

The present invention relates to working metals by applying pressure thereto and, more particularly, it relates to a bending head for a tube bending machine adapted to bend a tube or billet by pushing it through the bending head.

The present invention can be used to utmost advantage for high-speed continuous three-dimensional or spatial bending of tubes.

There are known bending heads for tube-bending machines in the prior art (see, for example, U.S. Pat. No. 3,373,587, Cl. 72–158), having a housing with a through axial passage, mounted in a cantilever fashion on the framework of the machine for forceful rotation about the axis thereof, the tube or billet being processed being pushed in the direction of this axis. Said rotation of the housing provides for varying the plane of bending of the billet.

There are mounted of the free end of the housing in the passage thereof in succession a pair of support rolls intermediate of which is the tube being pushed and a bending roll supported for rotation on an arbour mounted on a pivotable arm kinematically connected with the drive of the machine by means of a screw couple and a gear. The axes of rotation of all the rolls and of the pivotable arm are substantially perpendicular to the axis of the billet.

In the heads of the prior art the bending arm is made up of two toothed sectors permanently meshing with toothed racks mounted on the nut of the screw couple, this couple being made up of two concentric hollow sleeves of which the internal one acting as the screw is freely received about the hollow cylindrical housing of the bending head, the end of this sleeve rigidly supporting on the end thereof a gear kinematically connected to the drive of the machine.

The motion of the pivotable arm with the bending roll in the course of a billet bending operation and the rotation of the housing of the head are both effected by this same gear.

However, the rotation of the housing can be effected only after the pivotable arm has returned into its initial (neutral) position, with the end face of the nut of the screw couple abutting against the end face of the screw and the torque rotating the pinion overcoming the braking torque of a disc-type friction clutch mounted on the end of the housing of the head, the housing being supported by the framework of the machine.

In the course of a bending operation the friction clutch retains the housing of the bending head against self-inflicted rotation relative to the framework of the machine.

The main shortcoming of the abovedescribed bending heads is the fact that reversing the direction of the bending of the billet (i.e., varying the direction of its bending by 180°) is effected either by rotation of the housing of the head about the axis of the billet or by rotation of the billet itself through the same angle.

While the housing of the head is thus rotated, pushing of the billet into the head is discontinued, otherwise during this rotation of the housing an excessively long straight portion would remain in the billet intermediate of the two adjacent bends. Such interruptions in the operation of bending a billet affect the productivity of the bending head and of the machine as a whole.

Another shortcoming of the abovedescribed known bending head is the fact that the rotation of the housing thereof to vary the plane of bending of a billet can be effected solely in one direction and with the bending roll in a neutral position, which likewise affects the productivity of the bending head, since with such unidirectional rotation the angle through which the housing may be required to be rotated can be as great as 360°.

Furthermore, the possibility of rotating the housing of the head only after the bending roll has been retracted into the neutral position makes it impossible to have a smooth transition from planar bending of a billet to helical bending and vice versa.

Therefore, up to now tubular articles with intricate three-dimensional profiles were either assembled or welded together which both affected their appearance and increased their cost and would not permit the complete automation of the tube bending process as a whole.

The same shortcoming of the bending head of the prior art makes it incapable of turning out helically bent billets, which narrows down the scope of its applications.

It should be also noted that the bulk of the screw and nut couple enveloping the cantilever portion of the housing of the head cuts down the space that can be afforded to accommodate the bent portion of the billet and increases the weight of the bending head as a whole, while the relatively great thickness (i.e., the overall dimension of the head in a direction perpendicular to the plane of bending of a billet) of the head prohibits the reduction of the pitch of bending, e.g., of helical bending.

Finally, in the bending head of the prior art a considerable part of the length of its housing is taken up by the braking clutch, which is impractical, since it increases the overall length of the head and, hence, the length of the endmost straight portion of a billet section that has been processed, which increases the amount of waste.

It is an object of the present invention to create a bending head for a tube bending machine having the structure of its assemblies, which should permit reversible bending of the billets without rotating either the housing of the head or the billet itself and thus should remove from the operating cycle productivity affecting interruptions of the bending operation, associated with the rotation of the housing, which should step up the productivity of the bending head.

It is another object of the present invention to create a bending head wherein any variation of the plane of bending should be made possible by reversible rotation of the housing of the head, which should reduce the angles through which the head may be required to rotate and thus step up the producitivity of the head.

It is still another object of the present invention to create a bending head of a structure able to perform a process of bending billets into three-dimensional or spatial articles practically continuously and to perform it automatically.

It is a further object of the present invention to create a bending head having smaller dimensions in comparison with the hitherto known heads, as far as both the length and the width (i.e., the dimension in the plane perpendicular to the plane of bending) are concerned, without affecting the cantilever outreach of the head, which should reduce the bending pitch and thus render the head more versatile.

These and other objects are attained in a bending head of a tube bending machine, wherein the housing has a through axial passage and is mounted in a cantilever fashion on the framework of the machine for forceful rotation about the axis thereof, the billet being pushed through this head in the direction of the axis of the housing, there being mounted on the free end of the housing in the passage thereof a pair of support rolls and a pivotable arm, carrying a bending roll, kinematically connected with the drive of the machine via a screw-and-nut couple and a gear, the axes of rotation of all the abovementioned rolls and of the pivotable arm being substantially perpendicular to the axis of rotation of the housing, in said bending head, in accordance with the invention, an additional roll is mounted in opposition to each one of the abovementioned rolls in symmetry therewith with respect to the axis of rotation of the housing, the axis of rotation of the pivotable arm lying in the same plane with the axis of rotation of the housing, the latter having the end thereof, mounted on the framework, supporting the said gear for free rotation, there being mounted in direct proximity with said gear and coaxially therewith a second gear rigidly connected with the housing and independently kinematically connected with the drive of the machine.

The herein disclosed structure provides for reversing the direction of bending of a billet without rotating either the housing of the head or the billet itself, which permits reversing the direction of bending of the billet practically instantaneously and thus to step up considerably the productivity of the bending head.

Another feature of the herein disclosed structure is the possibility to do without unwanted straight portions of the billet intermediate of two adjacent bends, as is the case when billets are bent by the hitherto known heads, because in the latter prior to rotating the housing the bent portion of the billet is to be withdrawn from the bending rolls, least this portion might be damaged during such rotation.

Furthermore, with the same head being capable both of reversing the direction of bending and of reversing the rotation of its housing, the maximum angle of rotation required for varying the plane of bending has been reduced from 360° to 90°, i.e., to one fourth of that of the hitherto known heads, which also substantially increases the productivity of the bending head and of the bending machine, as a whole.

It is expedient that a bore should be made in the hub of the second gear eccentrically with respect to the axis of the rotation thereof and that this bore should receive therein the nut of the screw-and-nut couple, the nut having a toothed rim on the external surface thereof, permanently meshing with the internal toothed rim of the first gear, and that the screw of the screw-and-nut couple should be pivotally connected with the pivotable arm, through an intermediate member.

The eccentric arrangement of the screw-and-nut couple with respect to the axis of rotation of the housing of the head enables reduction of the thickness of the head, i.e., its size in a plane perpendicular to the plane of bending of a billet, and, hence, reduction of the bending pitch, i.e., helical bending pitch, which renders the bending head more versatile.

It is further expedient that both gears should be enclosed within a casing by means of which the housing of the head is mounted on the framework of the machine and that both end faces fo both gears and the internal walls of the casing should have made therein opposing annular grooves receiving therein a plurality of balls, in which way an antifriction bearing structure could be formed.

With this mounting of the housing of the head on the framework the overall length of the head can be reduced without reducing the length of the cantilever portion thereof.

Moreover, this mounting enables the transfer of the braking clutch to the drive system of the machine and to facilitate rotation of the housing of the head.

The passage within the housing of the head preferably has a tubular member extending axially thereof, one end of this member being mounted in a cantilever fashion in the framework of the machine and the opposite end thereof carrying a collet with rollers being biased or urged by a spring against the billet being pushed therebetween.

The last-mentioned structural feature enables minimizing the length of the endmost straight portion of a billet being treated at automatic bending thereof, when a preceding billet is pushed through the head by the following one.

This minimized length of the endmost portion of the billet practically eliminates any waste of the billet stock at bending.

The present invention will be further disclosed in connection with a description of an embodiment thereof, with reference being had to the accompanying drawings, wherein.

Figure 1:
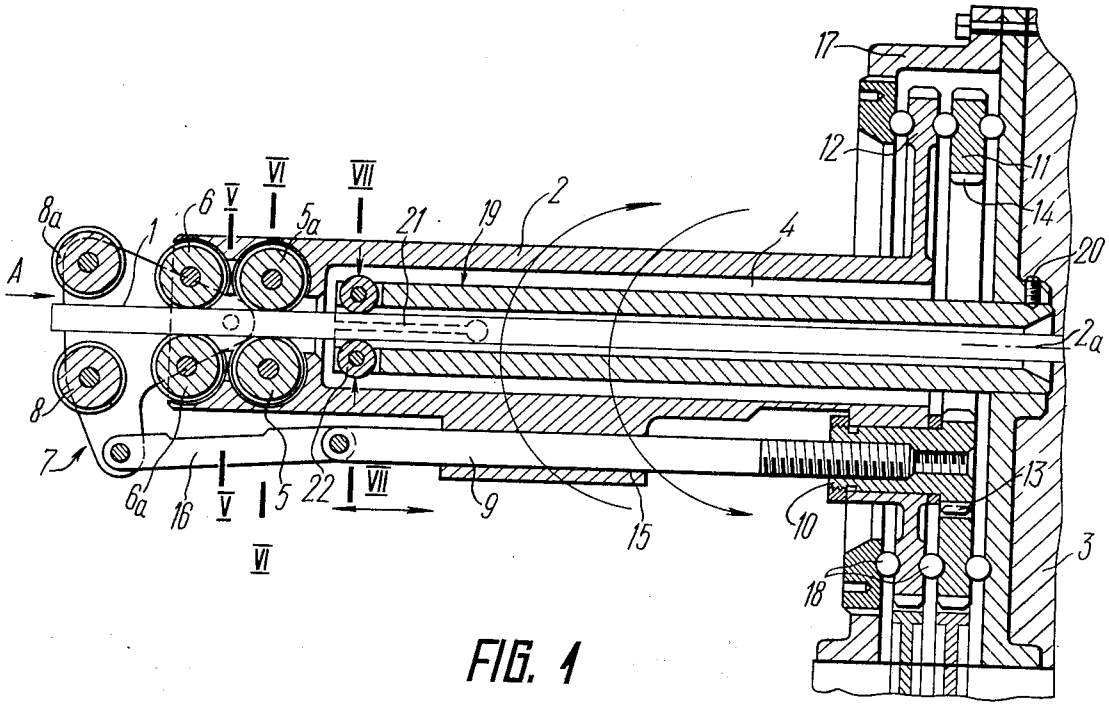
FIG. 1 is a scehmatic longitudinally sectional view of a bending head embodying the invention in the initial position of a bending operation.

In the drawings, the bending head in accordance with the invention is intended for incorporation in a bending machine effecting bending of a tube of billet (FIGS. 1 to 3) being pushed through the bending head.

The bending head includes a housing 2 having one end thereof mounted in a cantilever fashion on the framework 3 of the machine for rotation about its axis 2*a* and has an axial passage 4 extending therethrough, the billet 1 being pushed through this passage 4 along the axis thereof, said axis coinciding with the axis of rotation 2*a* of the housing 2.

The free end of the housing 2 has mounted in the passage 4 thereof, on both sides of the axis 2*a* of rotation of the housing 2, a pair of support rolls 5 and 6 which cooperate with the billet 1 being bent. There is also mounted on the free end of the housing 2 a pivotable arm 7 kinematically connected with the drive of the machine and carrying a bending roll 8. The axes of rotation of the rolls 5, 6 and 8 and the axis of pivoting of the arm 7 are substantially perpendicular to the axis 2*a* of rotation of the housing 2.

In accordance with the invention, there are mounted in opposition to each one of the support rolls 5 and 6 in the passage 4 of the housing 2 and to the bending roll 8 on the pivotable arm 7 additional rolls 5*a*, 6*a*, and 8*a* arranged symmetrically with their respective counterparts in relation to the axis 2*a*.

Figure 5:
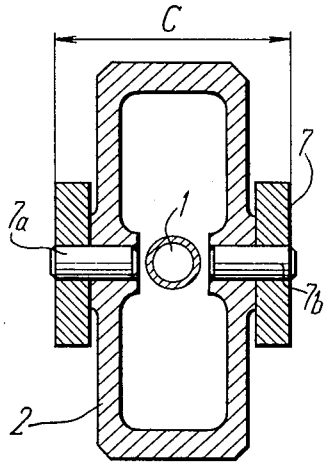
FIG. 5 is an enlarged sectional view taken on line V—V in FIG. 1.
Figure 4:
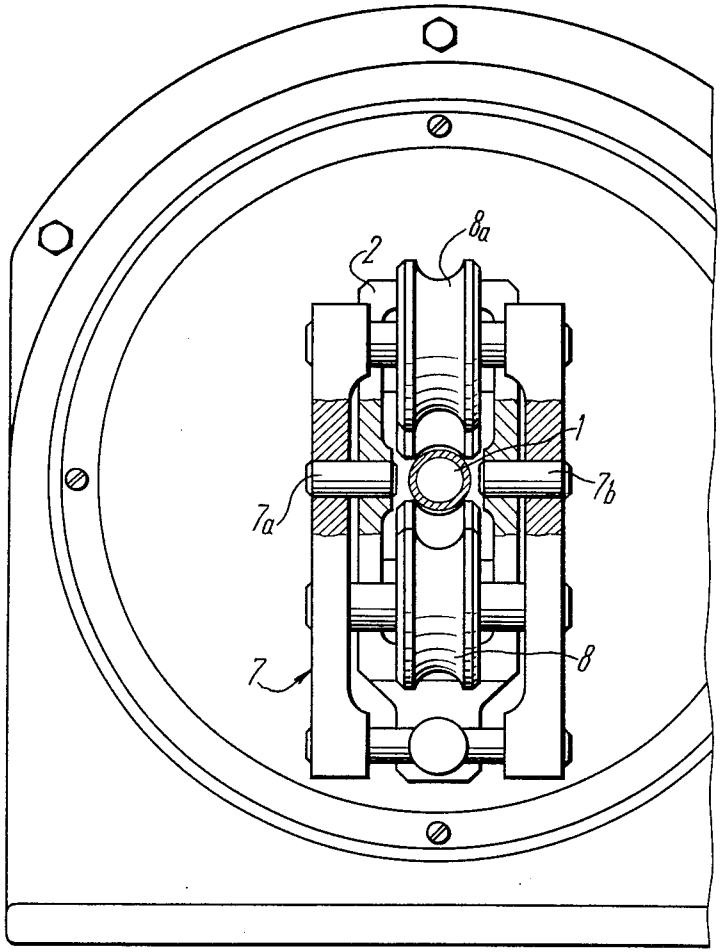
FIG. 4 is an enlarged view taken in the direction of arrow line "A" in FIG. 1.
Figure 6:
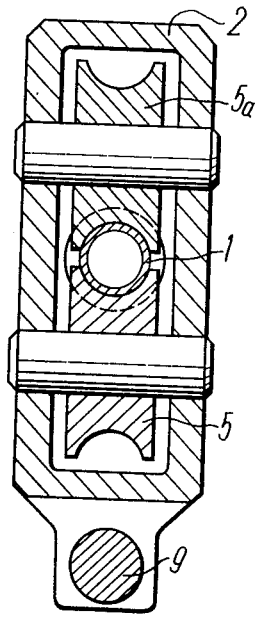
FIG. 6 is an enlarged sectional view taken on line VI—VI in FIG. 1.

The pivotable arm 7 is formed by two parallel sectors, (see FIG. 4) supporting therebetween the arbors about which the two bending rolls 8 and 8*a* are positioned for rotation, the narrower portions of these two sectors making up the arm 7 embracing therebetween the side walls of the housing 2 and being mounted thereon by means of two half-pins 7*a* and 7*b* (FIGS. 4 and 5) which together form the axis of pivoting of the pivotable arm 7, this axis, in accordance with the invention, lying in the same plane with the axis 2*a* of rotation of the housing 2.

The kinematic connection of the pivotable arm 7 with the drive of the machine includes a couple made up of a screw 9 (FIGS. 1 to 3) and a nut 10 and an annular gear 11, said gear being in accordance with the invention, mounted on the framework 3 in such a manner as to allow for free rotation about the end of the housing 2 and having the external teeth thereof in mesh with a drive pinion (not shown) belonging to the drive of the machine.

Mounted coaxially with the first gear 11 and adjacent thereto is another gear 12 which, in accordance with the invention, is rigidly connected with the housing 2 of the bending head and is independently kinematically connected with the drive of the machine.

A bore is made in the hub of the second gear 12 eccentrically with respect to the axis 2*a* of rotation of the housing 2, this bore receiving therein the nut 10 of the screw-and-nut couple, the nut 10 being provided on the periphery thereof with gear teeth, or a toothed rim 13, permanently meshing with the internal teeth 14 of the first gear 11.

The screw 9 of the screw-and-nut couple is in the form of a rod movable in a guideway 15 made in the housing 2 of the bending head eccentrically with respect to its axis 2*a* of rotation. The free end of the screw 9 is pivotably connected with the pivotable arm 7 by means of an intermediate member 16.

The eccentric arrangement of the screw-and-nut couple relative to the axis 2*a* of rotation of the housing 2 of the bending head allows for the reduction of the thickness "C" of the head (see FIG. 5 — i.e. the dimension of the head in a plane perpendicular to the plane of bending of the billet 1) and this, in turn, reduces the pitch of helical bending.

In accordance with the invention, the two gears 11 and 12 are enclosed with a casing 17 (FIGS. 1 to 3) by means of which the housing 2 of the bending head is mounted on the framework 3 of the machine.

The end faces of the two gears 11 and 12 and the internal walls of the casing 17 have opposing annular grooves cut therein, the grooves receiving a plurality of balls 18 supported in cages, in which way antifriction bearing means are formed.

This mounting of the housing 2 of the head on the framework 3 of the machine facilitates reversible rotation of the housing 2 about its axis 2*a* of rotation, when the plane of bending of the billet 1 is varied.

Figure 7:
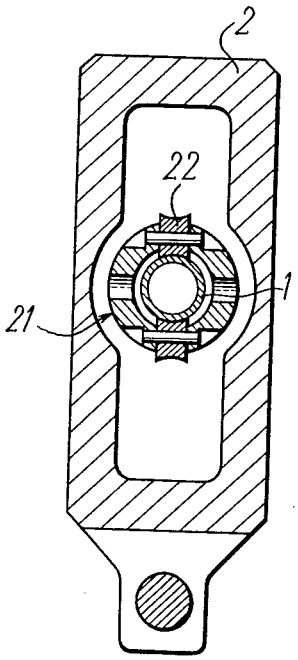
FIG. 7 is an enlarged sectional view taken on line VII—VII in FIG. 1.

The passage 4 of the housing 2 receives therein a tubular member 19 extending along the axis 2*a* of the housing 2, one end of the member 19 being mounted in a cantilever fashion in the framework 3 by means of a retaining screw 20, and the other end of the member 19 carrying a collet 21 with rollers 22 (FIGS. 1 and 7) spring-urged against the billet 1 being pushed therebetween.

The bending head embodying the present invention operates, as follows.

Bending of a billet 1 by the bending rolls 8 and 8*a* is effected as the billet 1 is being pushed through the passage 4 of the housing 2 of the head along the axis 2*a* of rotation of the housing 2, the billet 1 being continuously fed-in by the driving rolls (not shown) of the feed mechanism of the machine.

With the pivotable arm 7 occupying the neutral position with respect to the axis 2*a* of rotation of the housing 2, i.e., the position shown in FIG. 1, the billet 1 exits from the passage 4 of the housing 2 maintaining its straight shape.

Figure 2:
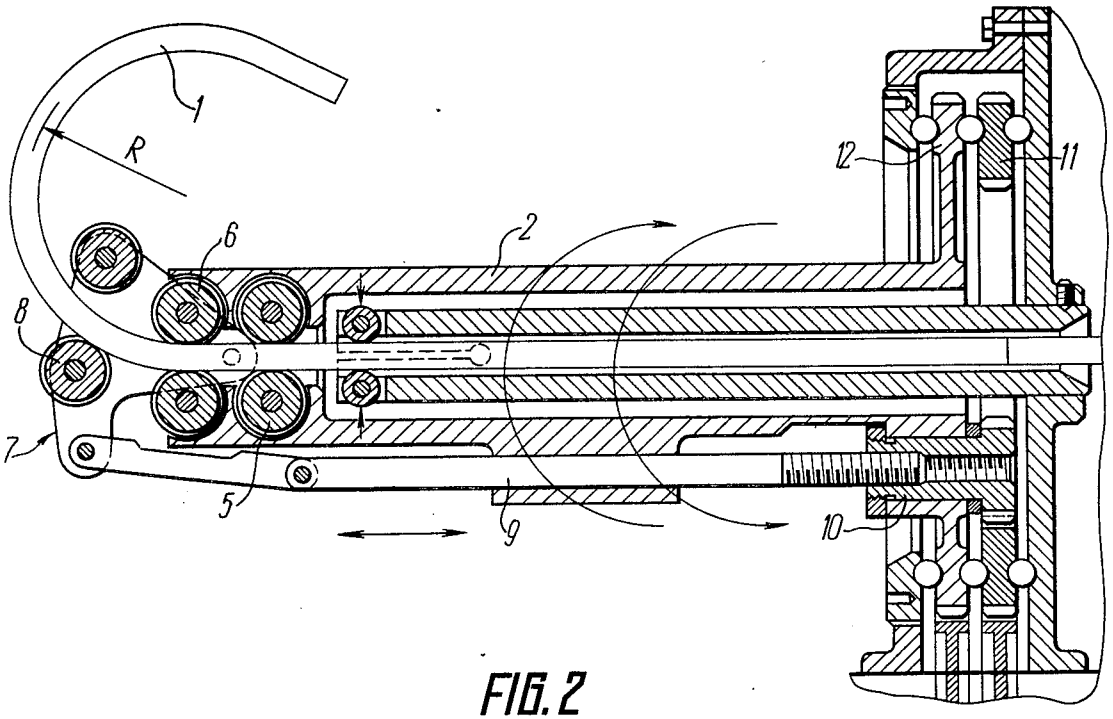
FIG. 2 is a veiw similar to FIG. 1, but with the billet being bent in one general direction.

When the arm 7 with the bending rolls 8 and 8*a* is pivoted upward from the neutral position with respect to the axis 2*a* of rotation of the housing 2, i.e., when it occupies the position shown in FIG. 2, the support rolls 5 and 6 and the bending roll 8 cooperate with the billet 1, and the latter is bent upwardly.

Figure 3:
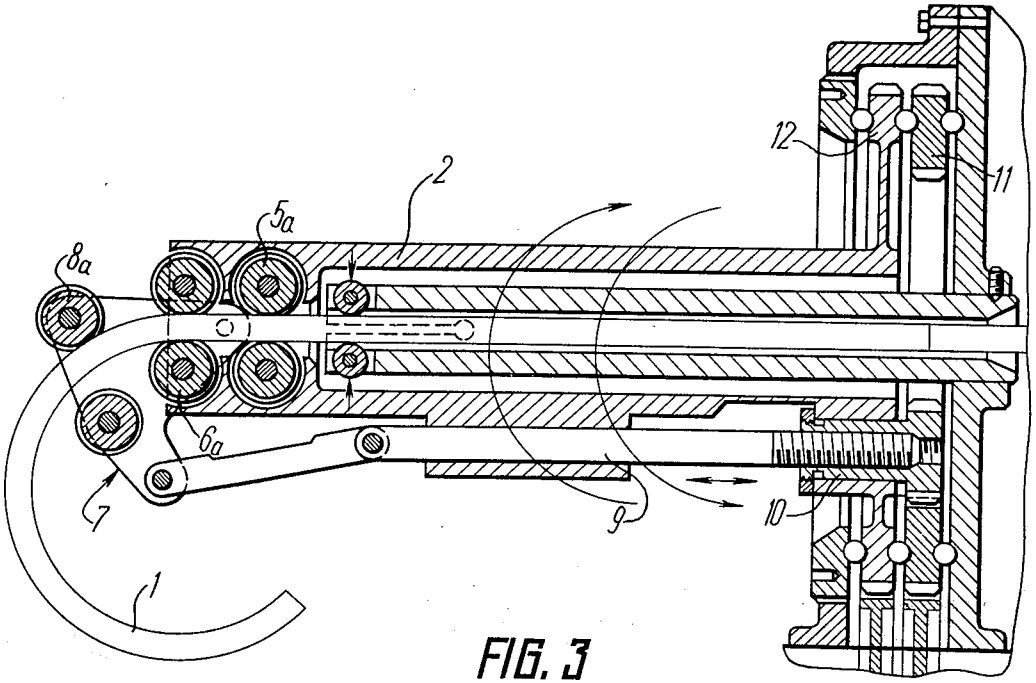
FIG. 3 is a view similar to FIG. 2, but with the billet being bent in the opposite direction.

When the arm 7 is pivoted downward from its neutral position, i.e. when it occupies the position shown in FIG. 3, the additional support rolls 5*a* and 6*a* and the additional bending roll 8*a* cooperate with the billet, and the latter is bent downwardly.

Thus, by reversing the pivoting of the arm 7 there is effected reversing of the direction of the bending of the billet 1, without any rotation of the housing 2 of the head.

The bending is done with the bending roll 8 (or 8*a*) bending the billet 1 about one support roll 6 (or 6*a*), while the other support roll 5 (5*a*) positioned at the opposite side of the axis 2*a* of rotation of the housing 2 takes up the counterpressure effort.

The value of the radius "R" (FIG. 2) of bending of the billet 1 depends on the angle through which the arm 7 is pivoted from the neutral position.

Pivoting of the arm 7 about its half-pins 7*a* and 7*b* in either direction relative to the axis 2*a* of the housing 2 is effected by the drive of the machine through the annular gear 11 from which rotation (via its internal toothed rim 14) is transmitted to the toothed rim 13 of the nut 10, wherefrom the motion is transmitted to the screw 9 which either screws into the nut 10 or screws outwardly therefrom, thereby actuating the arm 7 for pivoting in the corresponding direction via the intermediate member 16.

During the above operations the other gear 12 is braked.

Any variation of the plane of bending of the billet 1 at any angle differing from 180° is effected by a corresponding rotation of the housing 2 of the bending head about its axis 2*a* of rotation. This rotation is effected by the gear 12 independently of any pivoting of the arm 7, because the two gears 11 and 12 are independently operatively connected with the drive of the machine.

A tube bending machine incorporating a bending head embodying the invention is capable of bending automatically a tube or a billet to any required shape, which is impossible with the hitherto known bending machines.

Thus, helical bending of the billet 1 can be effected with the arm 7 been pivoted through an appropriate angle and with the housing 2 being rotated by the gear 12. In this case the pitch of helical bending, i.e., the helical angle of the helical curve, depends on the ratio of the rate of feed of the billet 1 through the housing 2 along the axis 2*a* thereof and the angular speed of rotation of the housing 2 of the bending head about this axis 2*a*.

Variation of the direction of helical bending is effected by reversing both the direction of pivoting of the arm and of rotation of the housing, i.e., by reversing the rotation of the gears 11 and 12.

Bending of billets with a varying curvature radius (i.e., bending into complex curves) is effected by pivoting the pivotable arm 7 at a varying angular rate. By selecting the appropriate character of pivoting of the arm 7 any required complex curve can be attained, e.g., an Archimedian curve.

As the billet 1 leaves the feed mechanism, i.e., when the trailing end of the billet 1 clears the feed mechanism in its motion into the bending head, it is being pushed forward by the leading end face of the successive billet abutting against its trailing end. Self-inflicted rotation of the billet 1 after its trailing end has cleared the feed mechanism is prevented by the rollers 22 mounted in the collet 21 carried by the member 19, the rollers unobstructedly letting the billet advance along the axis 2*a* of the housing 2, owing to their being mounted for rotation, but preventing rotation of the billet about its axis until the billet clears these rollers, which thereby reduces the wasting of the billet stock.

A bending head constructed in accordance with the invention provides for a higher productivity of the bending operation, as compared with the hitherto known bending heads, owing to the continuity of the billet or tube bending process, to the reduction of the maximum angle through which the housing of the head may be rquired to turn, down to 90°, at varying the bending plane, and to the increased rate of this turning, due to the reduced dimensions of the head and its weight.

These expanded production facilities of the head, i.e., the possibility of obtaining more complicated three-dimensional shapes and patterns, have been made possible by the reversibility of the rotation of the housing 2 and of the angle of bending of the billet or tube, which can be effected either separately or in combination.

We claim:

1. A bending head for a tube bending machine having a framework and a drive, comprising: a housing mounted in a cantilever fashion on said framework for forceful rotation about the axis thereof, said housing having a passage extending axially therethrough, through which a billet is pushed during a bending operation; a pair of support rolls mounted at the free end of said housing in the passage thereof, so that their respective axes of rotation are disposed at opposite sides of the axis of said housing and are substantially perpendicular thereto; a pivotable arm mounted on the free end of said housing, so that the axis of pivoting thereof is substantially perpendicular to the axis of rotation of said housing; a bending roll mounted of said pivotable arm, so that the axis or rotation thereof is substnatially perpendicular to the axis of rotation of said housing; a pair of additional support rolls mounted in the passage of said housing in opposition to the respective ones of said pair of support rolls and symmetrically therewith with respect to the axis of said housing; an additional bending roll mounted on said pivotable arm in opposition to said bending roll and symmetrically therewith with respect to the axis of said housing; a first gear mounted for free rotation on the end of said housing, mounted on said framework, and kinematically connected with said drive of the machine; a screw-and-nut couple by means of which said pivotable arm is kinematically connected with said first gear; a second gear mounted adjacent to said first gear and coaxially therewith, said second gear being rigidly secured to said housing and being independently kinematically connected with said drive of the machine.

2. A bending head as claimed in claim 1, wherein the hub of said second gear has made therein a bore eccentric relative to the axis of rotation of said housing, said bore receiving therein the nut of the screw-and-nut couple, the nut having a toothed rim on the periphery thereof, permanently meshing with internal teeth provided on said first gear, the screw of said screw-and-nut couple being pivotally connected with said pivotable arm through an intermediate member.

3. A bending head as claimed in claim 1, wherein both said gears are enclosed within a casing by means of which said housing of this head is mounted on the framework of the machine, the end faces of said gears and the internal walls of said housing having made therein opposing annular grooves receiving therein a plurality of balls, forming jointly an antifriction bearing structure.

4. A bending head as claimed in claim 1, wherein there is mounted in the passage of said housing along the axis thereof a tubular member having one end thereof mounted in a cantilever fashion in said framework, and the other end thereof carrying a collet with rollers spring-urged against the billet being pushed therebetween.

* * * * *